United States Patent [19]

Oliver

[11] 4,106,693

[45] Aug. 15, 1978

[54] AUTOMATIC FIREPLACE HEATING SYSTEM

[76] Inventor: John F. Oliver, 112 W. 31st St., Wilmington, Del. 19802

[21] Appl. No.: 790,014

[22] Filed: Apr. 22, 1977

[51] Int. Cl.[2] ..... F24B 7/04

[52] U.S. Cl. ..... 237/51; 237/55; 126/121; 165/35; 165/DIG. 2

[58] Field of Search ..... 237/51, 55; 126/121, 126/110 R, 117, 114; 165/DIG. 2, 35; 122/20 B

[56] References Cited

U.S. PATENT DOCUMENTS

| | | | |
|---|---|---|---|
| 1,245,488 | 11/1917 | Millis | 122/20 B |
| 1,633,759 | 6/1927 | Breese, Jr. | 122/20 B |
| 1,885,267 | 11/1932 | Kalfus | 122/20 B |
| 2,070,987 | 2/1937 | Genovan, Jr. | 122/20 B |
| 2,252,046 | 8/1941 | Steele | 122/20 B |
| 2,322,016 | 6/1943 | Hardeman | 237/51 |
| 2,343,542 | 3/1944 | Faunce | 237/55 |
| 2,362,940 | 11/1944 | Skerritt | 165/DIG. 2 |
| 3,650,318 | 3/1972 | Avery | 165/35 |
| 3,844,233 | 10/1974 | Fishback | 122/20 B |
| 3,991,821 | 11/1976 | Cook et al | 122/20 B |
| 4,004,731 | 1/1977 | Zung | 126/121 |
| 4,012,191 | 3/1977 | Lisamkie et al. | 237/55 |
| 4,025,043 | 5/1977 | Cleer, Jr. | 126/121 |
| 4,049,194 | 9/1977 | Tice et al. | 126/121 |
| 4,050,627 | 9/1977 | Mayer | 165/DIG. 2 |
| 4,053,106 | 10/1977 | Karl | 122/20 B |

*Primary Examiner*—John J. Camby
*Assistant Examiner*—Henry C. Yuen
*Attorney, Agent, or Firm*—Plumley and Tyner

[57] ABSTRACT

An automatically controlled residential heating system based on the heat from a fireplace comprising the normal fireplace, hearth, combustion zone, flue, and damper; the flue being divided into two parallel flue passages one of which is unobstructed and the other of which contains a heat exchanger adapted to absorb the heat from the flue gases into air passing through the heat exchanger and then into space heating elements in the residence; the system including automatic devices for sensing the temperature in the residential spaces to be heated, an automatic control to act upon the temperature sensing means and to move a diverter which serves to pass the flue gases into either or both of the parallel flue passages in any desired proportion and an automatic control for an air blower to circulate the hot air leaving the heat exchanger.

2 Claims, 3 Drawing Figures

AUTOMATIC FIREPLACE HEATING SYSTEM

This invention relates to a residential heating device based on the heat from a fireplace, and more particularly it relates to a fully automatically controlled system for utilizing the heat in the flue gases of the fire-place system to heat air which can be circulated to space heaters at any desired location in the residence.

Fireplaces are well known features of many residences. In some instances these fireplaces are the main sources of heat for the room in which the fireplace is located while in other instances they serve principally as a decorative feature supplying the pleasing effect of burning logs while actually making very little use of the heat generated in the fireplace. In some instances the fireplaces are adapted for burning logs or coal while in other instances they are fitted with gas-or oil-fired burners and do not rely upon the combustion of solid fuels for the generation of heat. Regardless of the features of the system employed it is universally true that only a very small portion of the heat generated in the fireplace is used to heat the building in which the fireplace is located. The major portion of the heat produced by the fireplace which is transmitted into the room in which the fireplace is in the form of radiation energy from the flame of the burning fuel and the combustion gases which rise through the flue are expelled outward through a chimney with the heat in those gases being substantially completely unused in heating the residence. There is, of course, a certain amount of heating of the walls of the flue which in turn provide heat for the areas of the residence near those walls but this is a relatively minor effect.

Many attempts have been made in the past to recover some portion of the heat in the combustion gases from a fireplace. These usually have involved air spaces in the walls of the fireplace arranged to provide natural circulation by convection or provided with a fan to produce a forced circulation. In any event, these systems supplement the radiation heating from the fire. In my copending application, Ser. No. 769,726 filed Feb. 17, 1977, there is described a system for conserving the heat from the flue of a fireplace by absorbing that heat in water circulating in a heat exchanger in the flue and employing the heated water to heat other rooms, the system being regulated by automatic controls.

It is an object of this invention to provide a residential heating system based on the heat derived from a fireplace. It is another object of this invention to provide an automatically controlled heating system for utilizing the waste heat and flue gases to supplement the heating system in a residence. It is still another object of this invention to provide a fully automatically controlled system for absorbing the heat from flue gases and releasing that heat in distant locations by means of a hot air circulating system. It is still another object of this invention to provide a fully automatically controlled heating system for absorbing the heat in flue gases and releasing that heat in distant locations to supplement the normal heating system. Still other objects will appear from the more detailed description of this invention which follows.

The objects of this invention are accomplished by providing a residential heating system based on the heat from a fireplace comprising a fireplace, hearth, combustion zone, flue, and damper for opening and closing the passageway from the combustion zone to the flue, said flue being divided into two full-sized, parallel, independent flue passages, one of which is filled with a heat exchanger adapted to absorb the heat from hot gases passing through the flue into air circulating inside said heat exchanger, a movable diverter adapted to direct the hot gases into either parallel flue or into both in any desired proportion, a means for circulating air through said heat exchanger and releasing the absorbed heat through space heaters at other locations, means for sensing the heat in the space to be heated by space heaters, and means for automatically positioning said diverter to by-pass none, all, or any part of said hot gases from said heat exchanger in response to the temperatures of the said sensing means.

In the attached drawings.

Figure 1:
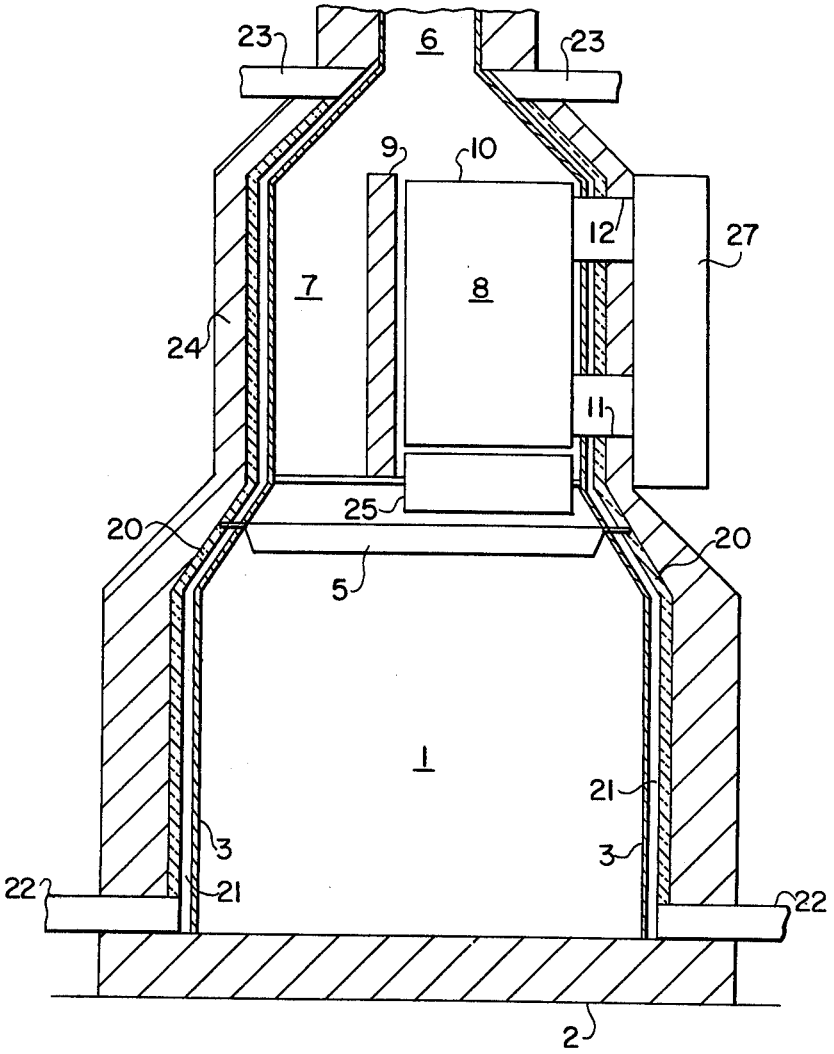
FIG. 1 is a cross-sectional front elevation view of a fireplace and flue containing the heating system of this invention.

The more detailed features of this invention can be understood by the reference to the attached drawings which are schematic illustrations of how the features of the system for absorbing heat in the flue are connected to other devices and how the heat is utilized in heating other areas. With specific reference to FIG. 1, the fireplace comprises a combustion zone 1 formed by a hearth 2 and fire walls 3. In the upper portion of combustion zone 1 damper 5 is located in the throat of the flue and is adapted to close combustion zone 1 from the upper portions of the flue. Above damper 5 there is a flue passage which is divided into two normal-sized flues in accordance with the requirements of combustion zone 1. These two flue passageways are parallel and independent of one another, being separated by divider wall 9. First flue passage 7 is unobstructed and of a proportion and design which would normally be employed for the size required by combustion zone 1. Second flue passage 8 is filled with heat exchanger 10 which is designed with vertical passageways for flue gases to rise therethrough and is of such a size in combination with the cross-sectional area of second flue passage 8 to permit the free flow of flue gases upwardly. Above the upper portions of flue passages 7 and 8 the cross-sectional area is reduced to the normal size to form smoke pipe 6 for conducting the smoke and gases upwardly to be discharged into the atmosphere. The outer extremities of flue passages 7 and 8 as well as smoke pipe 6 are defined by flue walls 24 which are normally made of refractory brick and are insulated to contain heat inside the passage. At the lower end of the divider wall 9 there is located diverter 25 which is adapted to divert the flue gases rising from combustion zone 1 into either or both of flue passages 7 and 8. The diverter may assume other forms or be fashioned in other designs so long as it is capable of closing one flue passage and opening the other.

The system which absorbs the heat from the rising hot flue gases generated in combustion zone 1 is located in second flue passage 8 and comprises heat exchanger 10. This heat exchanger may be of any appropriate design and made of any suitable material which will permit the upward flow of flue gases around the outside of heat exchanger (10) and the interior flow of air to absorb as much as possible of the heat from those flue gases. Because of the corrosion problems inherent in such a system, it is preferred that the heat exchanger be made of cast iron. It is, of course, to be understood that any other suitable material may be employed, such as stainless steel, aluminum, titanium, copper, or any of a wide variety of alloys which are suitably resistant to high temperatures and to corrosion under the conditions found in a residential flue. In the embodiment shown in this drawing the heat exchanger is made up of several independent sections which are joined together to provide any desirable heat exchange capacity. The particular design of the outer features of heat exchanger 10 are unimportant except that they should be available for cleaning purposes so as to maintain a high level of heat exchange efficiency and the contour must be so constructed as to make available the maximum surface for absorbing heat from the flue gases passing by. There are many designs which are suitable for such a purpose including fins, tortuous passageways, reverse pipe bends, etc.

Cold air enters heat exchanger 10 at inlet 11 and after circulating through the interior passageways of heat exchanger 10 leaves with the maximum absorption of heat at exit 12. This hot air is then available to discharge its absorbed heat at any suitable location to which exit 12 may be connected, normally to space heaters in other areas of the building.

The electric control system which operates the heating system of this invention is centered about a control switch 18 which is operatively connected to one or more room thermostats 19 which function to demand heat at some room location distant from the fireplace. In response to the demands of thermostats 19 control switch 18 can cause solenoid 26 to move diverter 25 to open or close flue 8 or to any partial opening desired. Alternatively, solenoid 26 may operate only to push diverter 25 against the operation of a spring (not shown), which in the absence of any force from solenoid 26 maintains the entrance to flue passage 8 in a fully opened or fully closed position, as desired.

The control and sensing devices employed in this invention are conventional appliances and auxiliary devices which may be obtained from any well equipped supply organization. The entire control system embodied by control switch 18 solenoid 26 and the necessary leads and conduits for connecting those devices are preferably enclosed in a suitable panel box 27 on the back or the side of a fireplace such that all items would be available for servicing and adjustment.

In FIG. 1 there is also shown a means for supplementing the heating system of this invention. A layer of insulation 20 is shown on the inside surface of the fireplace combustion zone 1 and the two flues 7 and 8 extending from the hearth 2 to the smokepipe 6. Inside of and contiguous to layer 20 is an air jacket 21 having inlets 22 for cold air and outlets 23 for hot air. This jacket 21 serves as a supplemental heat absorbing means to absorb heat from the fire in combustion zone 1 and the hot flue gases in flues 7 and 8 and to transmit that heat to air circulating through jacket 21. Inlets 22 and outlets 23 can be connected to an inlet 11 and air outlet 12, respectively, or to the existing hot air heating system in a residence or passed through appropriate conduits to any location where it is desirable to discharge the heat, e.g. to a room that is not adequately heated by other means. In preferred embodiments, the air passing through jacket 21 is moved by a suitable fan (not shown). The combination of jacket 21 and insulation layer 20 may be constructed as a unit and placed in an existing fireplace and flue as prefabricated sections. If the insulation is of adequate thickness and quality the sections can be installed with "zero clearance," i.e. without leaving space for expansion due to heating and cooling, thus facilitating the installation. The combination of jacket 21 and insulation layer 20 is preferably installed with zero clearance at the time the fireplace is originally built.

Figure 2:
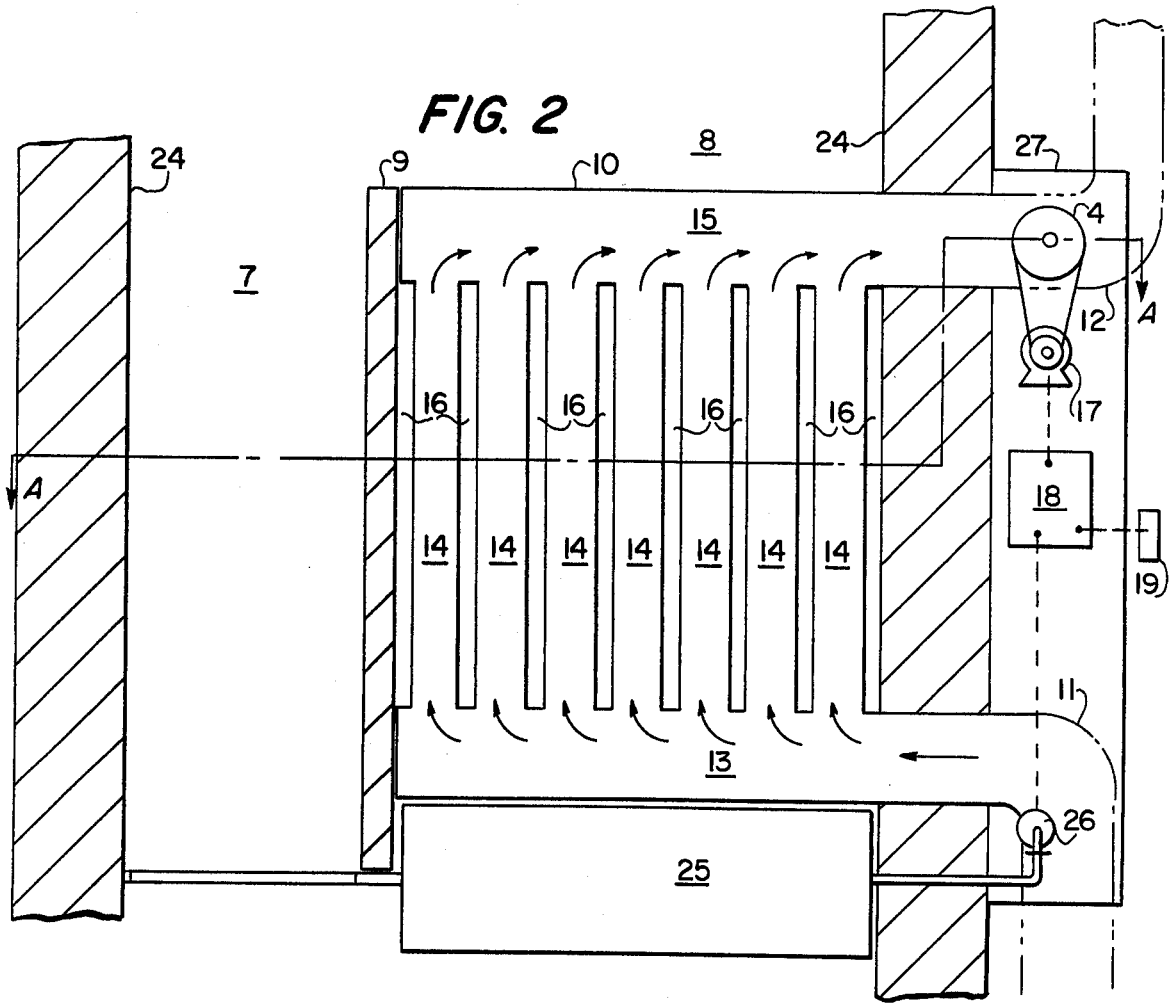
FIG. 2 is a cross-sectional front elevation view of the heat exchanger and control system.
Figure 3:
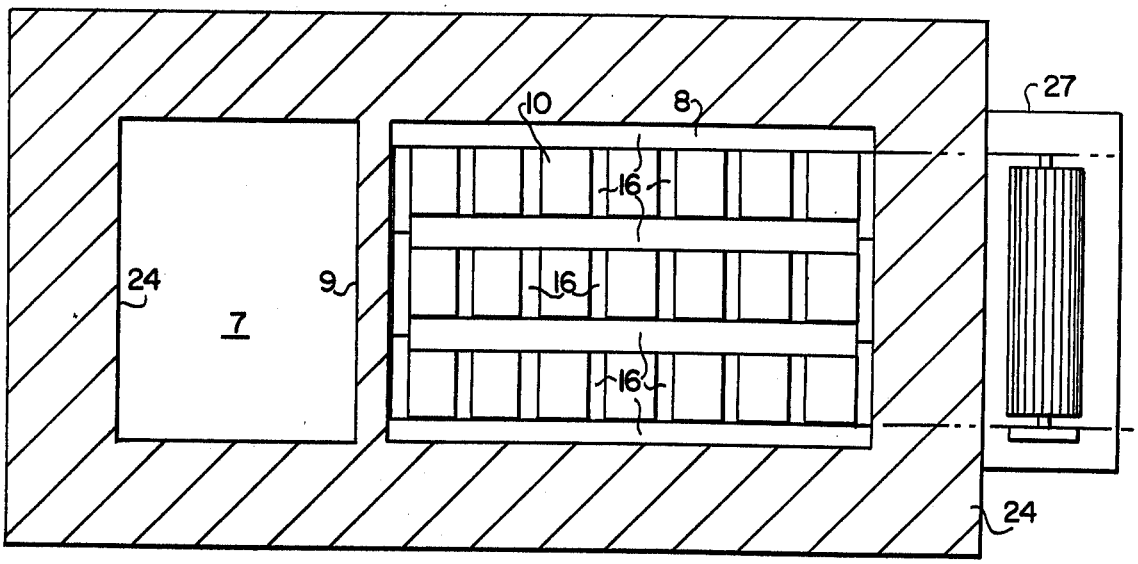
FIG. 3 is a cross-sectional view taken along A—A of FIG. 2.

In FIGS. 2 and 3 the details of heat exchanger 10 and the controls in panel box 27 may be seen. FIG. 2 is intended to show in elevation how heat exchanger 10 is arranged in flue passage 8 for the circulation of air inside the heat exchanger to be heated by hot flue gases outside the heat exchanger. There is no criticality in the particular design of heat exchanger 10 so long as it affords the maximum opportunity for heat to be withdrawn from the hot gases passing upwardly in the flue and to be absorbed by the air inside heat exchanger 10. In the design shown in FIGS. 2 and 3 inlet conduit 11 is the cold air return in the heating system of the building and it leads into one or more horizontal inlet headers 13 each of which is joined to a multiplicity of vertical tubes 14 which direct the flow of air upward to one outlet header 15, which in turn conducts the heated air to outlet 12 and thence to an area to be heated by discharge of the heated air into that area. The same area is, of course, connected to outlet 11 in such a fashion as to remove cool air from the area for return to heat exchanger 10 to complete the circuit. On the outside of headers 13 and 15 and vertical tubes 14 is adequate space 16 for flue gases to circulate in their upward flow. Preferably heat exchanger 10 is made from more than one unit which can be joined together at their respective inlet headers 13 and outlet headers 15 so as to fill any size of flue passage. In FIG. 3 there is illustrated the use of three such heat exchangers joined in parallel flow.

Control panel box 27 is intended to contain the controls for the heating system and as much piping and wiring as possible to provide a central location for servicing as well as to hide the unsightly appearance of such equipment. In outlet 12 there is located blower 4 driven by electric motor 17. If possible, motor 17 is enclosed by panel box 27. Also enclosed in panel box 27 are control switch 18, solenoid 26 and the wiring joining these pieces of equipment. Depending on the size of flue passages 7 and 8 and the available space for diverter 25 it may be necessary to provide more than one diverter to cover the entire opening of each flue passage, and thereby it may be necessary to provide a solenoid for each separate diverter. This is merely a matter of optimum design and it is intended that these alternatives are all included within this invention.

There are many alternative means for accomplishing the sensing and control operations set forth in the above description. It is not intended that any one means be employed to the exclusion of others since the foregoing description is merely illustrating the basic features of the invention. Furthermore, the heating system of this invention is not intended to be restricted solely to fireplaces. There are hot flue gases passing upwardly through flues in every residence, office building, and factory that is heated by coal, oil, gas, or the like. The system of this invention can be employed to conserve the heat in any flue of such buildings. Moreover, the present invention can be easily adapted to supplement heating systems employing solar heat, heat pumps, or any other type of heating wherein a circulating fluid is heated in one location and pumped to another location to discharge its heat.

Although the invention has been described in considerable detail with reference to certain preferred embodiments thereof, it will be understood that variations and modifications can be effected within the spirit and scope of the invention as described hereinabove and as defined in the appended claims.

What is claimed is:

1. Automatically controlled residential heating system based on the heat from a fireplace comprising a fireplace, hearth, combustion zone, flue, and damper for opening and closing a passageway from the combustion zone to the flue, said flue being divided into two full-sized parallel independent flue passages by a flue divider, one of which is an unobstructed normal flue passage and the other of which is filled with a heat exchanger adapted to absorb the heat from hot flue gases passing through the flue into air inside said heat exchanger, a movable diverter adapted to direct the hot flue gases into either parallel flue or into both in any desired proportion, a means for circulating air through said heat exchanger and releasing the absorbed heat through space heaters at other locations, temperature sensing means for sensing the heat in the space to be heated by space heaters, and means for automatically positioning said diverter to by-pass none, all, or any part of said hot flue gases from said heat exchanger in response to the temperature of the said sensing means.

2. An automatically controlled heating system to recover and use the heat in hot flue gases passing through a flue from the furnace to the chimney of a building comprising two full-sized parallel independent flue pssages both of which are connected at their lower extremities to the outlet of the combustion one of a furnace and both of which are connected at their upper extremities to the chimney conducting the flue gases out of the building to the atmosphere, one of said flue passages being an unobstructed normal flue passage and the other of which being filled with a heat exchanger adapted to absorb the heat from the hot flue gases passing throuh the flue into air inside said heat exchanger, a movable diverter adapted to direct the hot flue gases into either parallel flue or into both in any desired proportion, a means for circulating air through said heat exchanger and releasing the absorbed heat through space heaters at other locations, temperature sensing means for sensing the heat in the space to be heated by space heaters, and means for automatically positioning said diverter to by-pass none, all, or any part of said hot flue gases from said heat exchanger in response to the temperature of the said sensing means.

* * * * *